US008789462B2

(12) United States Patent
Chauvin et al.

(10) Patent No.: US 8,789,462 B2
(45) Date of Patent: Jul. 29, 2014

(54) METHOD AND SYSTEM FOR MAINTAINING SUBSTANTIALLY UNIFORM PRESSURE BETWEEN ROLLERS OF A PRINTER

(75) Inventors: Martin Chauvin, Tel Aviv (IL); Elad Taig, Ramat Gan (IL); Michel Assenheimer, Kfar Sava (IL); Haggai Abbo, Kyriat Ono (IL); Gilad Tzori, Moshav Satariyya (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 351 days.

(21) Appl. No.: 13/059,391

(22) PCT Filed: Sep. 15, 2008

(86) PCT No.: PCT/US2008/076389

§ 371 (c)(1),
(2), (4) Date: Feb. 16, 2011

(87) PCT Pub. No.: WO2010/030292

PCT Pub. Date: Mar. 18, 2010

(65) Prior Publication Data

US 2011/0150517 A1 Jun. 23, 2011

(51) Int. Cl.
*B41F 5/00* (2006.01)
*B65H 5/02* (2006.01)

(52) U.S. Cl.
USPC ..... 101/216; 101/218; 271/272; 271/275

(58) Field of Classification Search
USPC ..... 101/216, 218, 247, 229, 230, 231; 271/272, 275, 277
See application file for complete search history.

(56) References Cited

U.S. PATENT DOCUMENTS

| | | | | |
|---|---|---|---|---|
| 3,395,638 | A * | 8/1968 | Kirkus et al. | 101/216 |
| 4,676,158 | A | 6/1987 | Ishii et al. | |
| 4,681,035 | A * | 7/1987 | Kobler et al. | 101/217 |
| 5,094,162 | A | 3/1992 | Tafel et al. | |
| 5,201,272 | A * | 4/1993 | Simon | 101/485 |
| 5,423,254 | A * | 6/1995 | Kimura et al. | 101/217 |
| 5,485,785 | A | 1/1996 | Schneider et al. | |
| 5,678,136 | A | 10/1997 | Watanabe et al. | |
| 5,937,755 | A | 8/1999 | Preuss et al. | |
| 6,827,414 | B2 | 12/2004 | Iwatsuki et al. | |
| 6,851,359 | B2 | 2/2005 | Dumoulin | |
| 6,934,486 | B2 | 8/2005 | Lee | |
| 7,151,248 | B2 * | 12/2006 | Harush et al. | 250/221 |
| 7,274,902 | B2 | 9/2007 | Holstun et al. | |
| 2002/0190191 | A1 | 12/2002 | Maurin et al. | |
| 2005/0095035 | A1 | 5/2005 | Vejtasa et al. | |
| 2005/0129426 | A1 * | 6/2005 | Tsunemi et al. | 399/159 |
| 2008/0157465 | A1 * | 7/2008 | Matsumoto | 271/277 |

FOREIGN PATENT DOCUMENTS

| | | | |
|---|---|---|---|
| DE | 4142792 | A1 | 6/1993 |
| EP | 0785070 | A2 | 7/1997 |
| JP | 2004101994 | | 2/2004 |
| JP | 09114238 | | 2/2007 |
| WO | 2006128849 | A2 | 12/2006 |

* cited by examiner

*Primary Examiner* — Ren Yan

(57) ABSTRACT

A method and system for maintaining a substantially uniform pressure between a pair of rollers is disclosed.

10 Claims, 7 Drawing Sheets

METHOD AND SYSTEM FOR MAINTAINING SUBSTANTIALLY UNIFORM PRESSURE BETWEEN ROLLERS OF A PRINTER

BACKGROUND

In a conventional offset printer, a series of rollers transfers ink in the form of an image from roller to roller until the ink is finally transferred onto a media. In this process, the media is fed into a pressure nip formed between the last two rollers, sometimes referred to as a transfer roller and a media roller. In most instances, the transfer roller includes a blanket, such as an electrically conductive rubber-coated fabric, for transferring the ink to the media. However, the blanket is typically secured to a cylinder of the transfer roller via a clamp or other fastening mechanism, which introduces a discontinuity on the surface of the transfer roller.

Unfortunately, this discontinuity disrupts a sensitive pressure distribution between the transfer roller and media roller when the discontinuity of the transfer roller engages the media roller. Among other problems, this disruption affects the quality of the printing on the media, resulting in problems such as banding on the media in areas of the media that pass adjacent to the discontinuity of the transfer roller.

Accordingly, conventional printers fall short of desired printing quality by failing to compensate for these discontinuities.

DETAILED DESCRIPTION

Figure 1:
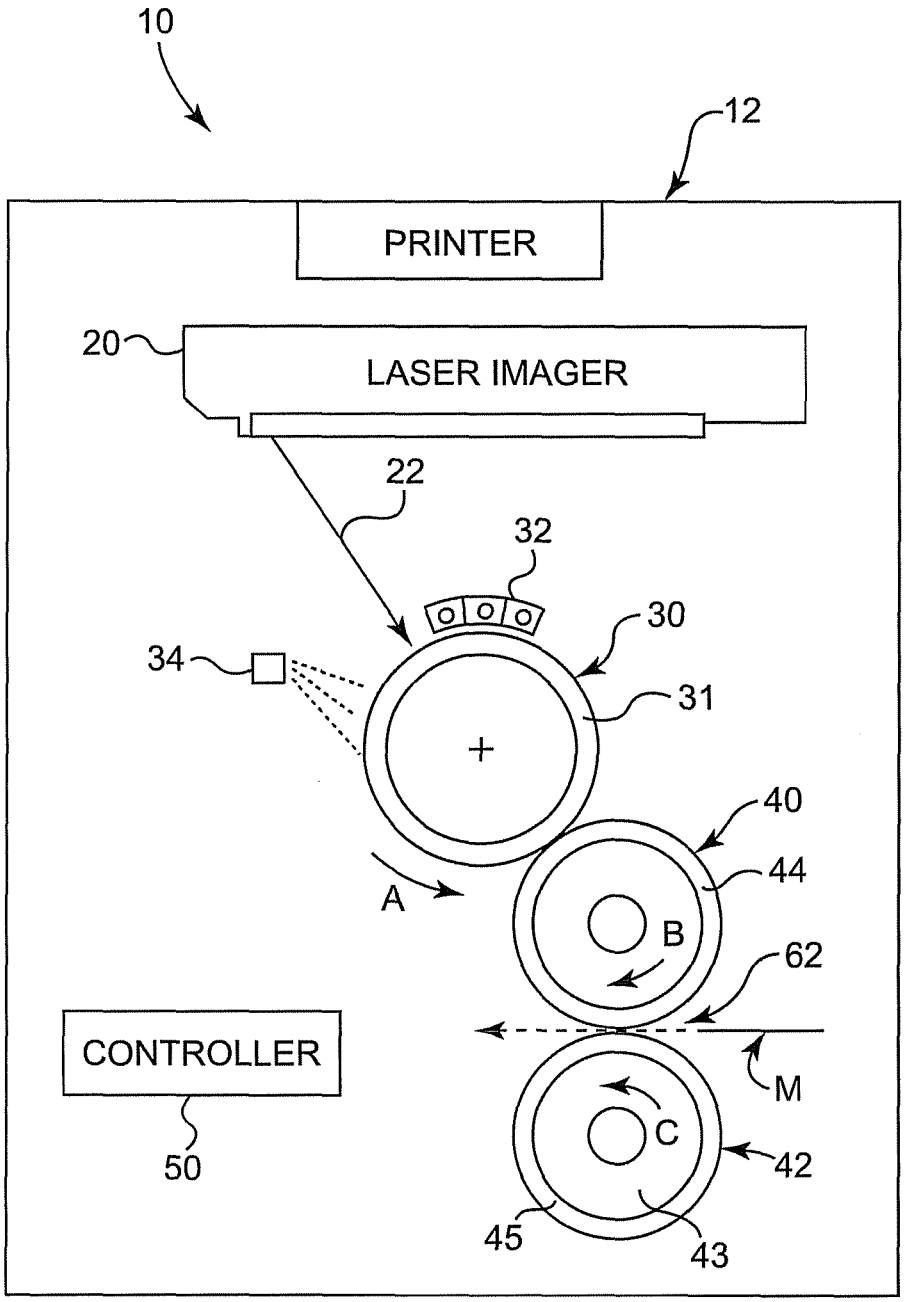
FIG. 1 is side view schematically illustrating a printing system, according to one embodiment of the present disclosure.

In the following Detailed Description, reference is made to the accompanying drawings, which form a part hereof, and in which is shown by way of illustration specific embodiments which may be practiced. In this regard, directional terminology, such as "top," "bottom," "front," "back," "leading," "trailing," etc., is used with reference to the orientation of the Figure(s) being described. Because components of embodiments of the present disclosure can be positioned in a number of different orientations, the directional terminology is used for purposes of illustration and is in no way limiting. It is to be understood that other embodiments may be utilized and structural or logical changes may be made without departing from the scope of the present disclosure. The following Detailed Description, therefore, is not to be taken in a limiting sense, and the scope of the present disclosure is defined by the appended claims.

Embodiments of the present disclosure are directed to maintaining a substantially uniform pressure between a first roller and a second roller of a printer. In one embodiment, the first roller and the second roller comprise a transfer roller and a media roller, respectively, which are in rolling contact with each other to form a pressure nip for transferring an ink image onto a media passing through the pressure nip. In other embodiments, the first roller and the second roller comprise a pair of rollers of a printer other than a transfer roller and/or a media roller and that are in rolling engagement with each other.

In one embodiment, the transfer roller comprises a cylinder (i.e. drum) and a blanket wrapped around the cylinder. In one aspect, with pressure applied by the media roller, the blanket of the transfer roller is compressed against an outer surface of the cylinder of the transfer roller resulting in the blanket having a compressed thickness in that region. In one aspect, the thickness of the compressed region of the blanket defines a distance of separation between the media (as carried on the media roller) and the cylinder of the transfer roller. For purposes of this application, this distance of separation between the media and the cylinder of the transfer roller is referred to as a gap and is an indirect measure of the amount of compression of the blanket. Nevertheless, it is understood that the gap does not represent an actual void because the media roller is in rolling contact with the blanket of the transfer roller and the media interposed therebetween. Accordingly, in one aspect, this gap (between the media and the cylinder of the transfer roller) plus the amount of compression of the blanket at the nip is substantially equal to the uncompressed thickness of the blanket.

In one aspect, a position of a rotational axis of the media roller is movable for translation of the media roller towards and away from a fixed position of a rotational axis of the transfer roller. This selective translation of the media roller enables controlling the gap and thereby controlling an amount of pressure applied at the pressure nip between the transfer roller and the media roller. In another aspect, translation of the media roller enables adjusting the pressure at the nip for different thicknesses of the media. With this in mind, in order to obtain high quality printing on the media, a substantially uniform gap should be maintained between the media roller (with the media carried thereon) and the transfer roller.

In one embodiment, an outer surface of the transfer roller includes a seam, such as a recess configured to enable clamping of the blanket on the cylinder of the transfer roller. In another embodiment, the media roller includes a seam. In yet other embodiments, both the media roller and the transfer roller include a seam. However, it is understood that in some embodiments, the seam may also comprise a raised protrusion instead of a recess and/or the seam may be unrelated to clamping of a blanket.

Nevertheless, a substantial majority of the blanket is free of such seams, and therefore the seam acts as a discontinuity that creates large disturbances on the force and position between the transfer roller and the media roller. These large disturbances disrupt maintaining a substantially uniform gap, which in turn disrupts application of a substantially uniform pressure between the media roller and the blanket.

In another aspect of the roller system of the printer, a coupling mechanism is interposed between the cylinder of the media roller and an axle from a motor that causes translation of the media roller. Because this coupling mechanism exhibits elastic properties and generally deforms due to the force exerted between the media roller and the transfer roller, further difficulty is encountered in maintaining a substantially uniform gap and thereby in maintaining a substantially uniform pressure. In particular, in attempting to achieve or maintain a substantially uniform gap, conventional systems fail to account for a gap differential or difference that exists between the actual gap (between the transfer roller and the media roller) and a gap setpoint with the gap differential being caused by the deformation of the coupling mechanism.

Nevertheless, because the deformation of the coupling mechanism remains generally constant in non-seam areas of the transfer roller, conventional encoder-based positioning mechanisms perform reasonably well in controlling the gap in non-seam areas of the transfer roller and therefore tend to maintain a substantially uniform pressure between the media roller and the transfer roller in non-seam areas.

On the other hand, the deformation of the coupling mechanism can vary dramatically in seam areas of the transfer roller. Unfortunately, these same conventional encoder-based positioning mechanisms are inadequate to compensate for the large force and position disturbances caused by the interaction of the seam of the transfer roller against the media roller. In one aspect, this force disturbance causes rapid deformation of the above-described coupling mechanism because of the elasticity of the coupling mechanism. Unfortunately, the conventional encoder-based positioning mechanisms are not capable of measuring this deformation because they are coupled to the axle of the motor causing the above mentioned translation. Therefore, they cannot provide a feedback signal which could be used to counteract the effect of this deformation.

However, embodiments of the present disclosure include a mechanism for adjusting the relative spacing between the transfer roller and the media roller to dynamically control the gap at the seam of the transfer roller to overcome the large change in the gap differential that would otherwise be caused by the elasticity of the coupling mechanism. This dynamic gap control mechanism thereby minimizes the force and position disturbance that would otherwise be caused by interaction of the seam with the media roller. In one aspect, this dynamic gap control mechanism is independent of, but operates in cooperation with, the conventional encoder-based positioning mechanism.

In one embodiment, the dynamic gap control mechanism maintains a constant gap setpoint in non-seam areas of the transfer roller but alters the gap setpoint when seam areas of the transfer roller interact with or engage the media roller. In particular, the gap setpoint is temporarily increased in the seam areas to counteract unwanted changes in the gap differential (due to the varying value of the deformation of the coupling mechanism of the media roller). By better controlling the gap differential in the seam areas of the transfer roller, this dynamic gap control mechanism enables maintaining a substantially uniform gap about an entire circumference of the respective media and transfer rollers despite the presence of the seam(s) on the transfer roller.

Accordingly, embodiments of the present disclosure maintain a substantially uniform pressure between the media roller and a transfer roller despite one or more seams on a surface of transfer roller, which in turn enables consistent, high quality printing.

These embodiments, and additional embodiments, are described in association with FIGS. 1-8.

One embodiment of a printing system 10 including a printer 12 is illustrated in FIG. 1. As shown in FIG. 1, printer 12 comprises a laser imager 20, an imaging roller 30, a transfer roller 40, and a media roller 42. In addition, the printer 12 comprises a charging station 32, a developing station 34, and a controller 50. In one aspect, the imaging roller 30 includes an outer electrophotographic surface or plate 31 while the transfer roller 40 includes a blanket 44.

While not shown in FIG. 1, in other embodiments the printer 12 additionally comprises excess ink collection mechanisms, cleaners, additional rollers, and the like as familiar to those skilled in the art. A brief description of the operation of the printer 12 follows.

In preparation to receive an image, the imaging roller 30 receives a charge from charging station 32 (e.g., a charge roller or a scorotron) in order to produce a uniform charged surface on the electrophotographic surface 31 of the imaging roller 30. Next, as the imaging roller 30 rotates (as represented by directional arrow A), the laser imager 20 projects an image via beam 22 onto the surface 31 of imaging roller 30, which discharges portions of the imaging roller 30 corresponding to the image. These discharged portions are developed with ink via developing station 34 to "ink" the image. As imaging roller 30 continues to rotate, the image is transferred onto the electrically biased blanket 44 of the rotating transfer roller 40. Rotation of the transfer roller 40 (as represented by directional arrow B), in turn, transfers the ink image onto media M passing through the pressure nip 62 between transfer roller 40 and media roller 42.

While not shown in FIG. 1, it is understood that in another embodiment media roller 42 also acts as the media supply with the media M being wrapped about a cylinder 43 of media roller 42 to form the outer portion 45 of media roller 42. In yet another embodiment, media roller 42 is configured to releasably secure media M to a surface of media roller 42 as media M passes through the pressure nip 62 so that media M is wrapped around media roller 42 at pressure nip 62.

Figure 2:
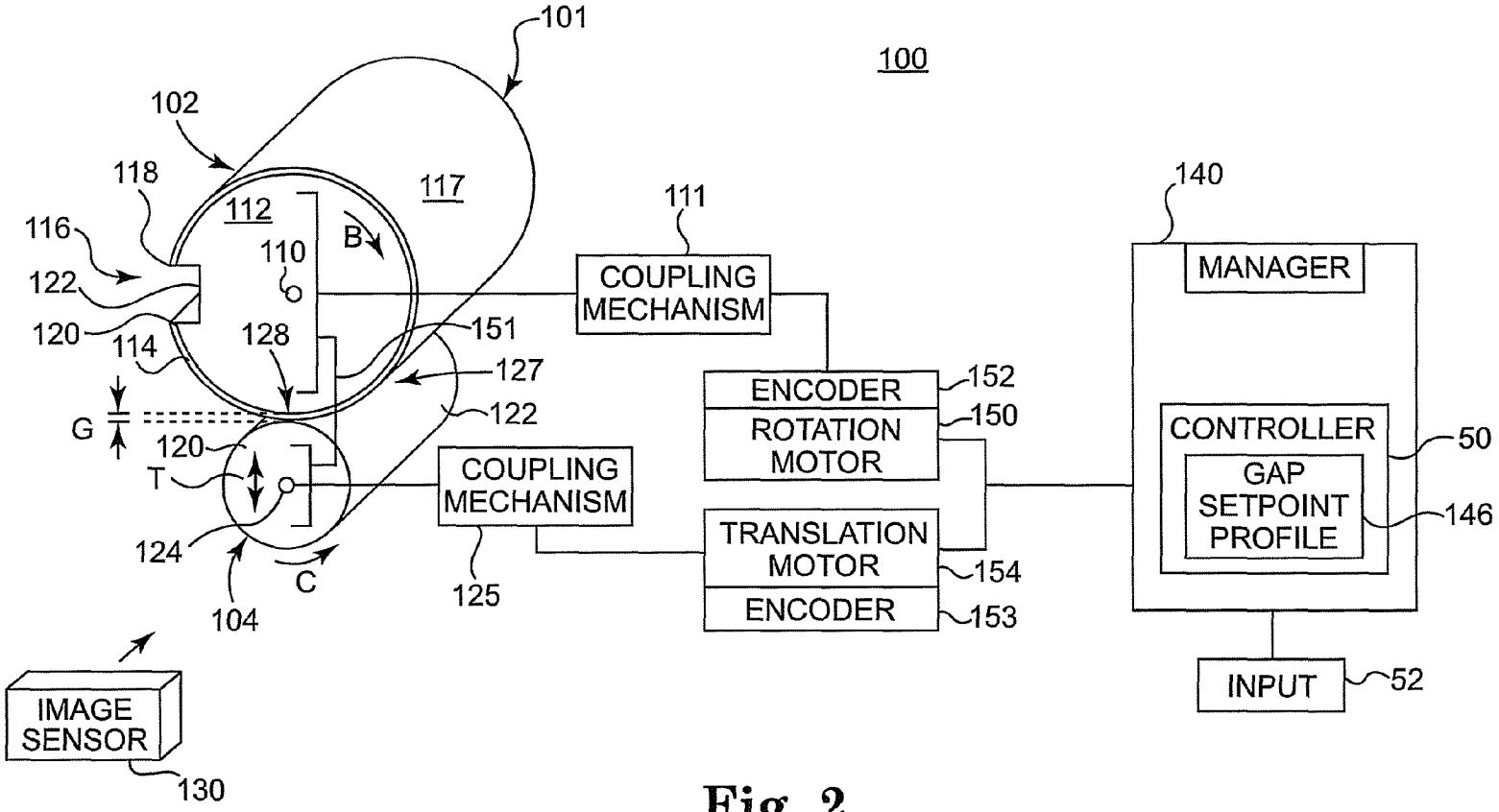
FIG. 2 is schematic illustration of a control system, according to one embodiment of the present disclosure.

FIG. 2 is a schematic illustration of a roller control system 100 of a printer, according to one embodiment of the present disclosure, which provides further details regarding the interaction of a media roller and a transfer roller. In one embodiment, roller control system 100 forms part of a printer comprising substantially the same features and attributes as printer 12 previously described in association with FIG. 1. In one aspect, roller control system 100 comprises a roller portion 101 including a transfer roller 102 and a media roller 104 that have at least substantially the same features and attributes as transfer roller 40 and media roller 42 of FIG. 1, respectively.

As shown in FIG. 2, transfer roller 102 is rotatable about axis 110 (as represented by arrow B) and includes a cylinder 112 with a blanket 114 secured onto cylinder 112. Axis 110 allows rotation of cylinder 112 but is otherwise fixed. In one aspect, a coupling mechanism 111 is disposed at least one end of cylinder 112 (e.g. drum) as schematically illustrated in FIG. 2 and is configured to couple cylinder 112 relative to an axle of the rotation motor 150 that controls rotation of transfer roller 102. In addition, FIG. 2 schematically illustrates a rotational link 151 associated with coupling mechanism 111. The rotational link 151 extends between transfer roller 102 and media roller 104 to transfer the rotational motion of transfer roller 102 to the media roller 104. In this way, rotation of media roller 104 is controlled via rotation of transfer roller 102. However it is further understood that other arrangements of controlling the rotation of transfer roller 102 and media roller 104 will be recognized by those skilled in the art.

In another aspect, cylinder 112 is formed of a metallic material and blanket 114 is formed of a conductive rubber material (or other conductive, elastic material) to enable cylinder 112 to electrically bias blanket 114. In another aspect, transfer roller 102 comprises at least one seam 116 positioned within non-seam area 117, which otherwise generally defines a substantial majority of the circumference of the transfer roller 102. As shown in FIG. 2, seam 116 comprises a recess including a first edge 118, an intermediate portion 122, and a second edge 120. In one aspect, among other functions, seam 116 is configured to secure a clamp or other fastening mechanisms to secure blanket 114 about cylinder 112. Accordingly, the position of blanket 114 generally corresponds to non-seam area 117 of transfer roller 102.

In another aspect, it is also understood that second edge 120 of seam 116 generally corresponds to a leading edge of a media M (e.g., such as a sheet) while first edge 118 of seam 116 generally corresponds to a trailing edge of a media M.

It is understood that in other embodiments, seam 116 may comprise a protrusion rather than a recess. In yet other embodiments, seam 116 is not exclusively associated with clamping a blanket 116 about cylinder 112 but comprises other geometrical variations or topographical features of transfer roller 102. Moreover, in other embodiments, media roller 104 also may include a seam 116. In yet other embodiments, both media roller 104 and transfer roller 102 include one or more seams 116.

As shown in FIG. 2, seam 116 extends generally parallel to a rotational axis (or a longitudinal axis) of the transfer roller 102. In one embodiment, seam 116 extends along at least a majority of a length of the transfer roller 102. In some embodiments, the seam 116 extends through a thickness of the blanket 114 and at least partially into the cylinder 112, as shown in FIG. 2.

Media roller 104 is rotatable about axis 124 (as represented by arrow C) and comprises a cylinder 120 which is configured to carry media 122 through an interaction zone 127 between media roller 104 and blanket 114 of transfer roller 102. In one aspect, a coupling mechanism 125 is disposed at one end of cylinder 120 as schematically depicted in FIG. 2 and is configured to couple cylinder 120 relative to an axle of a translation motor 154 that controls the translation of media roller 104 relative to transfer roller 102.

In another aspect, when non-seam areas 117 of transfer roller 102 are in rolling contact under pressure with media roller 104, the interaction zone 127 further defines a pressure nip 128. On the other hand, when seam 116 of transfer roller 102 engages media roller 104, the interaction zone 127 no longer defines a pressure nip 128 and then interaction zone 127 generally refers to the overlapping position and/or engagement between transfer roller 102 and media roller 104.

In one embodiment, axis 124 allows rotation of cylinder 120 and is also movable via translation of axis 124 (as represented by arrow T) towards and away from the rotatable (but otherwise fixed) axis 110 of transfer roller 102. However, in another embodiment, rotatable axis 124 of media roller 104 is generally fixed to prevent its translation while rotatable axis 110 of transfer roller 102 is also movable via translation toward and away from axis 124 of media roller 104. Accordingly, by moving axis 124 of media roller 104 toward and away from axis 110 of transfer roller 102 or by alternatively moving axis 110 of transfer roller 102 toward and away from axis 124 of media roller 104, one can vary the distance between media roller 104 and transfer roller 102.

With this in mind, media roller 104 is maintained in rolling contact under pressure against transfer roller 102 such that media roller 104 partially deforms blanket 114 of transfer roller 102 at pressure nip 128, as later described in more detail in association with FIGS. 3-4. In addition, the pressure of media roller 104 against transfer roller 102 is also indirectly measured by a gap (G) between cylinder 112 of transfer roller 102 and media roller 104 (with media 122 or M carried thereon), as also described in more detail in association with FIGS. 3-4.

In addition to rollers 102 and 104, roller control system 100 includes a control manager 140 configured to control operation of transfer roller 102 and media roller 104 as well as other rollers and functions of printer 12. As illustrated in FIG. 2, control manager 140 comprises a controller 50 configured to generate control signals to operate rotation motor 150 (to control rotation of both transfer roller 102 and media roller 104) and configured to generate control signals to operate translation motor 154 of media roller 104. In one aspect, the rotation motor 150 also comprises one or more associated drives, gears, or transmission mechanisms to enable control of the rotation of transfer roller 102 and of media roller 104, respectively.

In one aspect, the translation motor 154 controls translation of media roller 104 relative to transfer roller 102 (as represented by directional arrow T) to move media roller 104 towards and away from transfer roller 102. In one aspect, translation motor 154 may also comprise one or more associated gears, drives or transmission mechanisms to cause translation of media roller 104.

As further shown in FIG. 2, an encoder 153 is associated with and coupled to translation motor 154 and an encoder 152 is associated with rotation motor 150. In one aspect, encoder 152 indicates an angular position of seam 116 of rotatable transfer roller 102 while encoder 153 indicates a translational position of media roller 104 relative to transfer roller 102. With this arrangement, among other functions, control manager 140 is configured to generate control signals to implement a gap setpoint based on the angular position of the seam 116 of transfer roller 102 (as provided via encoder 152), as further described below. Referring again to FIG. 2, it is understood that the size of gap G (between the cylinder 112 of transfer roller 102 and media roller 104) is inferred via operation of encoder 153 associated with translation motor 154 of media roller 104. In addition, gap G remains generally constant through non-seams areas 117 of the transfer roller 102 that comprise a substantial majority of the circumference of the transfer roller 102. In these non-seam areas 117, controller 50 acts to maintain a generally constant gap G according to a generally constant gap setpoint based on feedback provided via encoder 153.

Nevertheless, it is further understood that in non-seam areas 117 a generally constant difference remains between the gap setpoint and the actual gap G, even when the encoder based-adjustments perform optimally. In particular, the gap differential exists because of the previously described elastic properties of the coupling mechanism between the cylinder of the media roller and an axle of the translation motor 154 of the media roller. Accordingly the gap setpoint is generally equal to a sum of the actual gap G and a previously described deformation of the coupling mechanism 125 of media roller 104. In other words, the actual gap G is generally equal to the gap setpoint minus the previously described deformation.

In the conventional systems, the limited range of adjustments (as enabled by the encoder 153) and the relatively slow speed of making these adjustments is not adequate to compensate for the large force and position disturbances caused by the seam 116 of transfer roller. This inadequacy is at least in part due to the very high speed of rotation of the transfer roller 102 and media roller 104 and also due to the deformation of the coupling mechanism 125 of the media roller 104, which introduces a large imperfection in the position reading (inferred from the encoder 153) of the media roller 104.

With this relationship in mind, the difference between the actual gap G and the gap setpoint can vary dramatically when seam 116 of transfer roller 102 passes through interaction zone 127 with media roller 104 (FIGS. 2-4), unless proper compensation is made to account for the elasticity of the coupling mechanism 125. In particular, in a conventional system, in the vicinity of seam 116 of transfer roller 104 the effect of the force disturbance on the coupling mechanism substantially alters the actual gap G, thereby corresponding to a substantial unwanted discrepancy between the actual gap G and the gap setpoint (e.g., requested gap). In a conventional system, the unwanted part of the substantial discrepancy (i.e. the part of the gap discrepancy that is in addition to the gap discrepancy already occurring in the non-seam areas 117) is left uncorrected, thereby resulting in long-term damage to the blanket 114 and poor printing quality, among other problems.

Accordingly, as later described in more detail in association with FIGS. 5-8, in one embodiment of the present disclosure, controller 50 employs a gap setpoint profile 146, which is configured to apply a generally constant gap setpoint in non-seam areas 117 of transfer roller 102 and to temporarily increase the gap setpoint in the vicinity of the seam 116 to thereby maintain a substantially uniform gap G between the media roller 104 and the cylinder 112 of transfer roller 102 (with partially compressed blanket 114 interposed therebetween) in the vicinity of the seam 116. In one aspect, the temporary increase in the gap setpoint is triggered based upon the angular position of seam 116 of rotating transfer roller 102. In particular, when the information from encoder 152 indicates that the angular position of seam 116 is approaching loss of contact with media roller 104 in the interaction zone 127 (FIG. 2), control manager 140 causes the temporary increase in the gap setpoint via the gap setpoint profile 146. This temporary increase in the gap setpoint compensates for the effect of the force disturbance that would otherwise occur in the vicinity of the seam 116 if a nominal gap setpoint (i.e., the setpoint applied in non-seam areas 117) were maintained about the entire circumference of the transfer roller 102.

By applying gap setpoint profile 146 to anticipate the force disturbance at the seam area 116 (and the associated elastic deformation of the coupling mechanism 125 of media roller 104), a substantially uniform gap G is maintained between transfer roller 102 and media roller 104. Moreover, by acting to maintain a substantially uniform gap G despite seam areas 116, gap setpoint profile 146 (as applied via control manager 140) provides a dynamic gap control mechanism to maintain a substantially uniform pressure about the entire rotation of the transfer roller 102, as later described in more detail in association with FIGS. 5-8.

Controller 50 comprises one or more processing units and associated memories configured to generate control signals directing the operation of printer 12, including roller control system 100. In particular, in response to or based upon commands received via input 52 (as well as information provided via encoders 152, 153) or instructions contained in the memory of controller 50, controller 50 generates control signals directing operation of rotation motor 150 and translation motor 154 to selectively control the gap G between the transfer roller 102 and media roller 104. In one aspect, controller 50 automatically adjusts the gap setpoint to accommodate the thickness of the media M so that the proper amount of pressure (and corresponding actual gap G) is applied for each of the different thicknesses of different types of media.

For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 50 may be embodied as part of one or more application-specific integrated circuits (ASICs). Unless otherwise specifically noted, the controller is not limited to any specific combination of hardware circuitry and software, nor limited to any particular source for the instructions executed by the processing unit.

In another embodiment, an image sensor 130 is temporarily employed during an evaluation phase of the printer 12 as a measurement tool in association with control system 100, as schematically depicted in FIG. 2. Accordingly, in one embodiment, the image sensor 130 does not form a portion of printer 12 and is not present during normal operation of printer 12 after completion of the evaluation phase of printer 12. In one embodiment, the sensor comprises a CCD laser displacement sensor. In one aspect, during the evaluation phase image sensor 130 is used to measure the displacement of media roller 104 that occurs when seam 116 of transfer roller 102 interacts with media roller 104. This measured displacement information is used to identify a gap setpoint profile that will maintain a substantially uniform gap G in seam area 116, as will be further described later in association with FIGS. 5-8.

However, it is further understood that in another embodiment image sensor 130 can be incorporated into printer 12 and be present during normal operation of printer 12 even though the image sensor 130 may or may not further contribute to controlling the gap via a gap setpoint profile.

Figure 3:
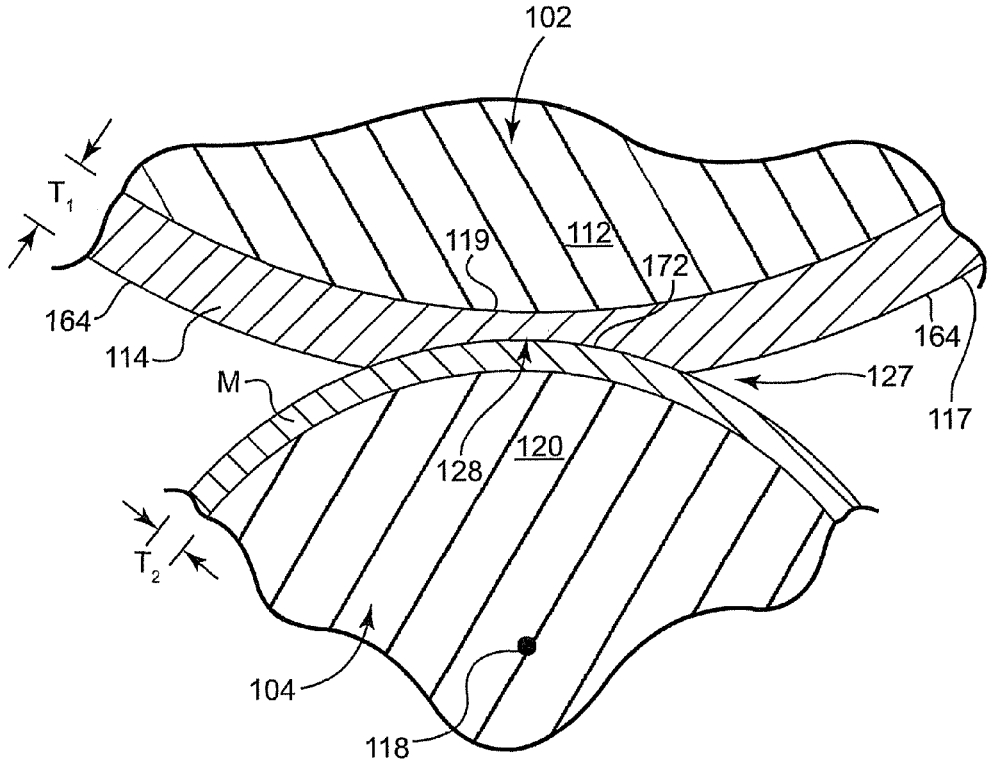
FIG. 3 is an enlarged sectional view schematically illustrating a pressure nip between a transfer roller and a media roller of the printing system, according to one embodiment of the present disclosure.
Figure 4:
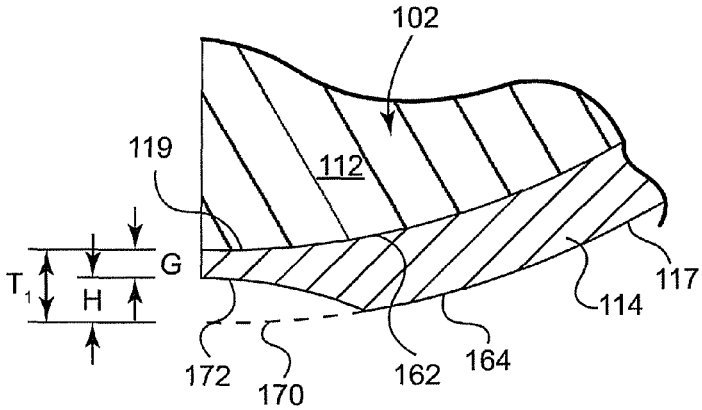
FIG. 4 is an enlarged partial sectional view schematically illustrating a transfer roller of the printing system, according to one embodiment of the present disclosure.

To better appreciate the "gap" being controlled between the media roller 104 and the transfer roller 102, FIGS. 3 and 4 provide enlarged sectional views of one non-seam area 117 of transfer roller 102 and the media roller 104 in the vicinity of the pressure nip 128, according to one embodiment of the present disclosure. As shown in FIG. 3, blanket 114 has thickness (T1) and media (M) has a thickness (T2) such that with media roller 104 (with media M carried thereon) pressing against transfer roller 102, blanket 114 is compressed or deformed within the pressure nip 128. As further shown in FIG. 3, the portions 164 of blanket 114 located outside of pressure nip 128 return to their uncompressed thickness T1. Although not depicted in FIGS. 3-4, it will be understood by those skilled in the art that a transition between the compressed region and un-compressed regions 164 of blanket 114 is typically smoother than the transition shown in FIGS. 3 and 4.

FIG. 4 is an enlarged partial sectional view of transfer roller 102 with media roller 104 removed for illustrative purposes to demonstrate the amount of compression of blanket 114 and how gap G is defined relative to the transfer roller 102 and the media roller 104. FIGS. 3-4 illustrate cylinder 112 of transfer roller 102 having an outer surface 119 while blanket 114 has an outer surface 164 and an inner surface 162.

As best seen in FIG. 4, the amount of compression of blanket 114 by media roller 104 (and with media M carried thereon) is represented by H. This compression is also indirectly measurable by the gap G between the media M and the outer surface 119 of cylinder 112 because a sum of the gap G and the amount of compression (as represented by H) is generally equal to the uncompressed thickness T1 of blanket 114. As illustrated in FIG. 4, dashed line 170 represents the outer surface of the blanket 114 in the area of pressure nip 128

(if it were in an uncompressed state) while portion 172 represents the outer surface of blanket 114 when compressed under pressure from media roller 104.

As illustrated by FIGS. 3 and 4, as non-seam areas 117 of transfer roller 102 pass through pressure nip 128 (of interaction zone 127), the gap G is a measure of the deformation of the elastic blanket 114 of the transfer roller 102 as media roller 104 is forced against the transfer roller 102.

As will be understood by those skilled in the art from viewing FIGS. 2-4, in a conventional system as seam 116 of transfer roller 102 passes through interaction zone 127, the gap G would change abruptly due to the changing distance between the center of the rotational axis 110 of transfer roller 102 and the center of the rotational axis 124 of media roller 104 in view of the substantially different topography of seam 116 (FIG. 2) as compared to the generally smooth contour of non-seam areas 117.

In contrast, embodiments of the present disclosure provide a dynamic gap control mechanism to compensate for the change in distance between the center of the rotational axes 110, 124 related to the different topography of seam 116 and related to the elasticity of coupling mechanism 125, as further described later in association with FIGS. 5-8. This arrangement, in turn, minimizes abrupt changes in gap G in the vicinity of seam 116.

Figure 5:
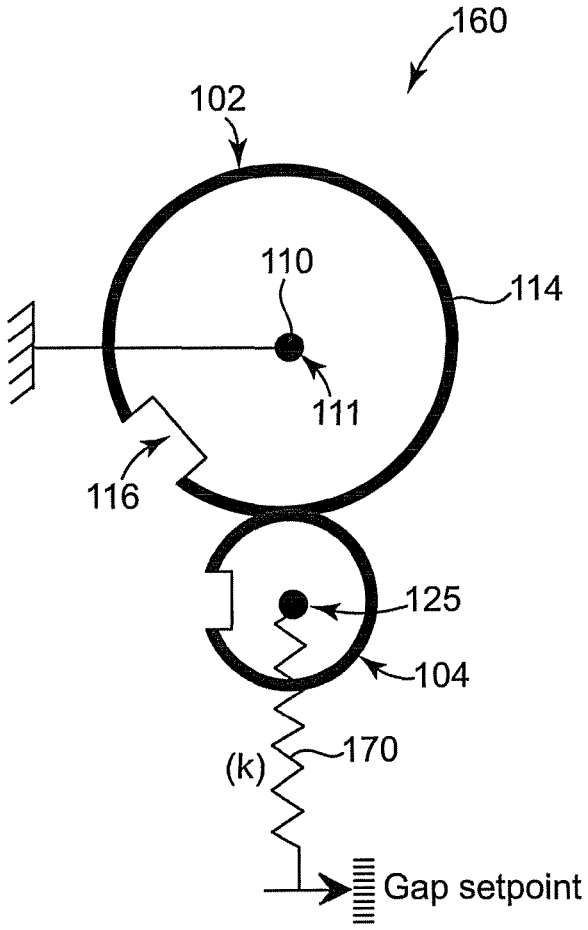
FIG. 5 is a diagram schematically illustrating a linear spring model for a coupling mechanism of a roller, according to one embodiment of the present disclosure.

To better appreciate the elasticity of the coupling mechanism 125, FIG. 5 provides a diagram 160 schematically illustrating a linear spring that represent the elasticity (i.e., the metal compliance) of coupling mechanism 125 of media roller 104 when media roller 104 and transfer roller 102 are in rolling contact under pressure by a force F. As represented by FIG. 5, the gap setpoint for a given force F is generally equal to an actual gap for the given force F plus the force F when divided by the spring constant k (i.e. F/k). In other words, the actual gap G for a given force F is generally equal to the gap setpoint for the given force F minus the force F when divided by the spring constant k (i.e. F/k). In one aspect, the spring constant k represents the elasticity of linear spring 170, which in turn provides a model of the elastic behavior of the coupling mechanism 125 of media roller 104. Accordingly, even when operating in non-seam areas 117, there is a generally constant difference between the gap setpoint and the actual gap due to the configuration of the coupling mechanism 125, which stores elastic energy in a manner similar to a linear spring as a result of the force or pressure exerted between media roller 104 and transfer roller 102. Moreover, this generally constant difference would remain even in the ideal case of a perfect encoder-based control system (in which the controlled quantity would always be equal to the setpoint).

Figure 6:
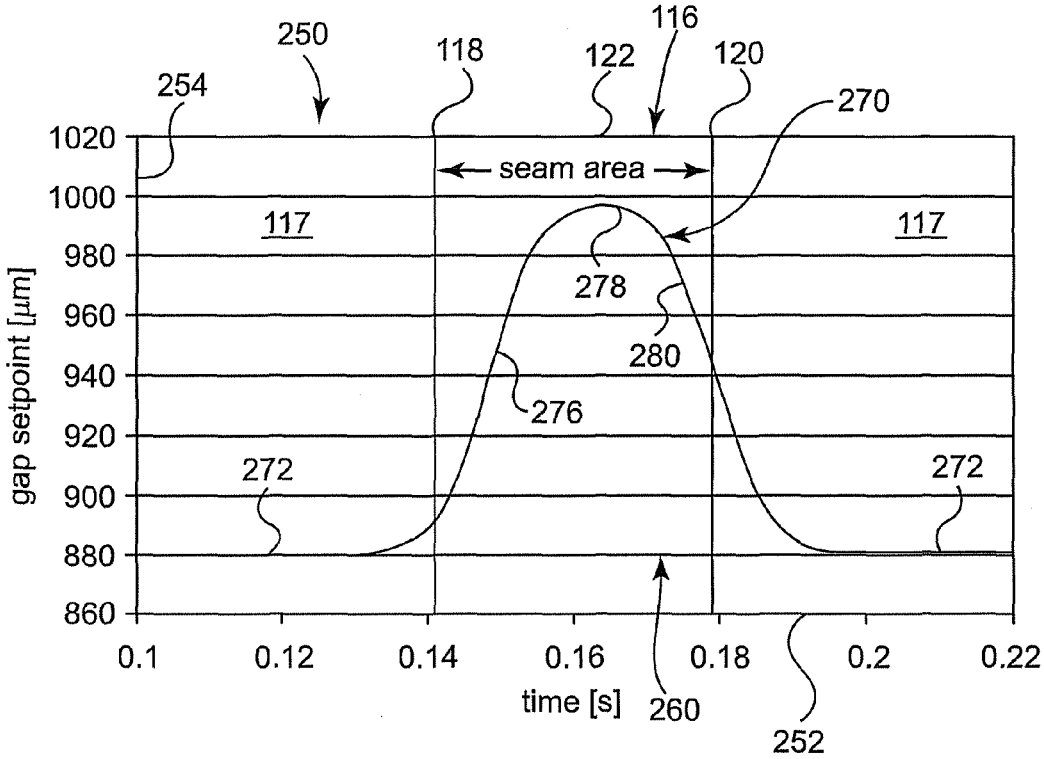
FIG. 6 is a diagram illustrating a gap setpoint profile, according to one embodiment of the present disclosure.
Figure 7:
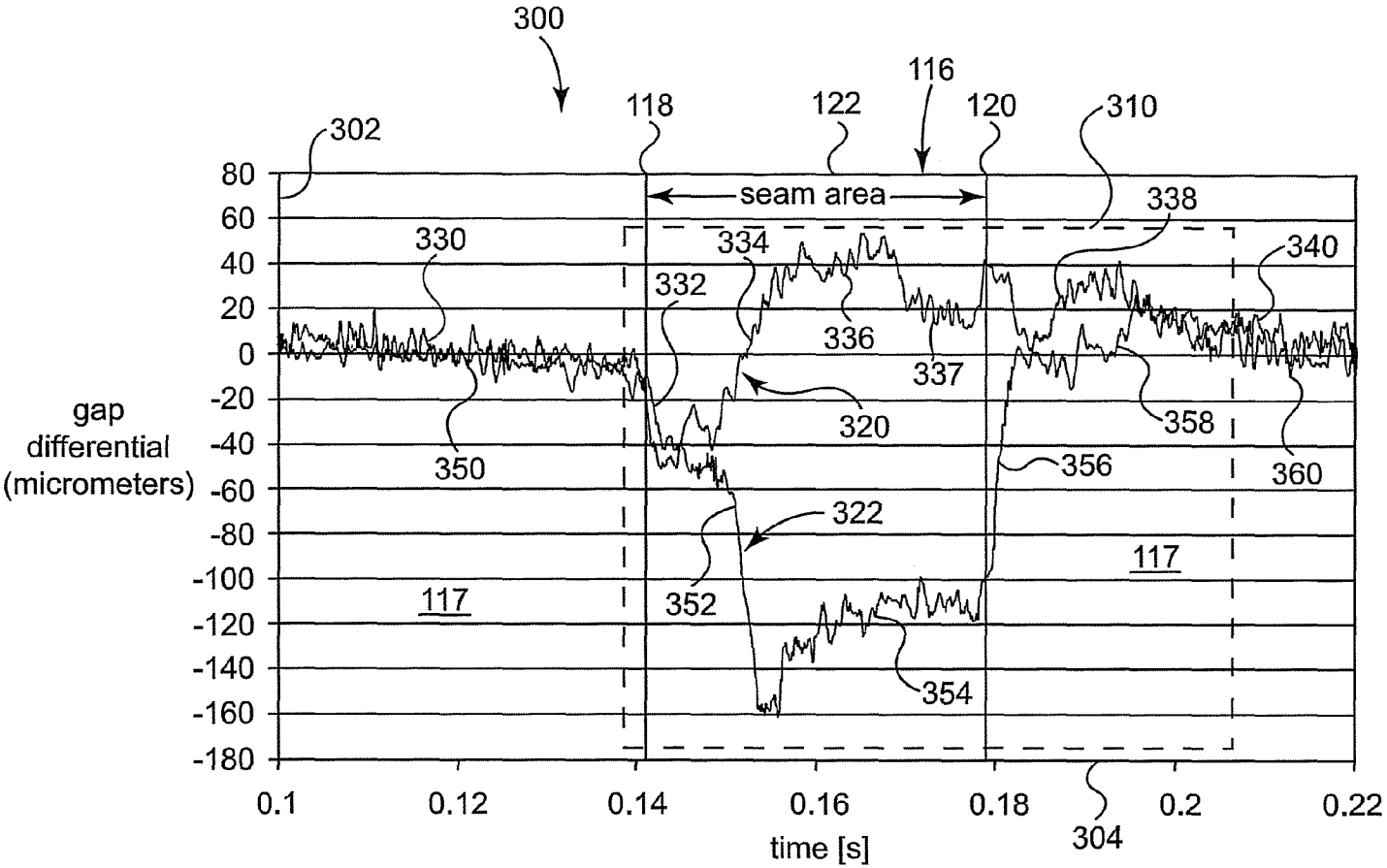
FIG. 7 is a diagram illustrating a gap differential profile, according to one embodiment of the present disclosure.

With these configurations in mind, FIGS. 6-7 will highlight a gap differential profile achieved via a gap setpoint profile, according to embodiments of the present disclosure. In particular, FIG. 6 is a graph illustrating a comparison of a conventional gap setpoint profile and a gap setpoint profile produced according to one embodiment of the present disclosure. Meanwhile, FIG. 7 is a graph illustrating a comparison of a conventional gap differential profile and a gap differential profile achieved according to one embodiment of the present disclosure. In one aspect, the gap differential represents the difference between the gap setpoint and the actual gap G while accounting for the amount of deformation due to the elasticity of coupling mechanism 125 of media roller 104 (when under a constant force F between rollers 102 and 104).

As illustrated in FIG. 6, graph 250 comprises a pair of gap setpoint profiles 260, 270 plotted on a horizontal axis 252 representing time (in seconds) and a vertical axis 254 representing a gap setpoint (in micrometers). This gap setpoint represents an input to achieve a desired distance of separation (i.e., an actual gap G) between the cylinder 112 of transfer roller 102 and media roller 104 (FIGS. 2-4). As illustrated in FIG. 6, certain landmarks of transfer roller 102 are identified in association with the gap setpoint profiles 260, 270. In particular, non-seam areas of the transfer roller 102 are represented by reference numeral 117 (also seen in FIG. 2) while line 118 on graph 250 represents the first edge of seam 116 (corresponding to a trailing edge of a media M), line 122 on graph 250 represents the intermediate portion of seam 116, and line 120 on graph 250 represents the second edge of seam 116 (generally corresponding to a leading edge of a media M).

As illustrated in FIG. 6, line 260 represents a conventional gap setpoint profile which remains generally constant (e.g. 880 μm in one example) through non-seam areas 117 and as seam 116 passes through the interaction zone 127 with media roller 104. Accordingly, in this conventional profile no modification in the gap setpoint is made to compensate for the force disturbance and position disturbance caused by seam 116 of transfer roller 102. The effect of maintaining this generally constant gap setpoint as seam 116 passes through the interaction zone 127 is illustrated in FIG. 7 by gap differential profile 322.

In particular, FIG. 7 comprises a graph 300 depicting a pair of gap differential profiles 320, 322 plotted on a horizontal axis 304 (representing time in seconds) and a vertical axis 302 representing a gap differential. In general terms, the gap differential is defined by the actual gap G minus both a gap setpoint and the deformation of coupling mechanism 125 of media roller 104, as previously described. Conventional gap differential profile 322 reflects the response of the roller system to the conventional gap setpoint profile 260 of FIG. 6, which maintains a generally constant gap setpoint through the seam 116 and which does not compensate for the mechanical deformation of coupling mechanism 125 of media roller 104 around the seam area 116. However, gap differential profile 320 in FIG. 7 corresponds to a gap setpoint profile 270, in accordance with embodiments of the present disclosure, which temporarily alters a gap setpoint at seam 116 and which compensates for the mechanical deformation of the coupling mechanism 125 of media roller 104 around the seam area 116.

As shown in FIG. 7, conventional gap differential profile 322 comprises a base value portion 350 representing the gap differential in non-seam areas 117 of transfer roller 102 which comprises a substantial majority of the rolling contact between transfer roller 102 and media roller 104.

However, as media roller 104 passes by the first edge 118 of seam 116, both the position of the media roller 104 and the pressure between the media roller 104 and transfer roller 102 will abruptly change as the media roller 104 drops into the intermediate portion 122 of seam 116. As the pressure between the transfer roller 102 and media roller 104 is abruptly relieved, elastic energy stored in the coupling mechanism 125 is abruptly released. These dramatic changes are reflected in FIG. 7 as the gap differential of the conventional roller system abruptly plummets from zero to about negative 160 micrometers (represented by portion 352). This abrupt drop defines a maximum displacement of the rotational axis 124 of media roller 104 relative to the fixed rotational axis 110 of transfer roller 102 when seam 116 passes through interaction zone 127 (FIG. 2).

As further illustrated in FIG. 7, as intermediate portion 122 of seam 116 passes through interaction zone 127 with media roller 104, the coupling mechanism 125 initially experiences a generally dynamic state of recovery with the gap differential eventually leveling off at near negative 120 micrometers (represented by portion 354) throughout a majority of the intermediate portion 122 of seam 116. However, with no pressure nip 128 functioning at this time within interaction zone 127, this relatively large gap differential does not directly affect printing. However, FIG. 7 further illustrates that in this conventional system the gap differential again changes abruptly as media roller 104 bumps into the second edge 120 of seam 116, with the gap differential quickly changing from near negative 120 micrometers to near zero micrometers (represented by portion 356). In one aspect, this bumping action causes a large force disturbance between the transfer roller 102 and the media roller 104 (FIG. 2-4). This results both in a rapid deformation of the elastic blanket 114 (as blanket 114 becomes pinched at the second edge 120 of seam 116) and in a rapid deformation of the coupling mechanism 125 (via the compliance or elasticity of its metal components) leading to an immediate displacement of media roller 104 relative to the fixed transfer roller 102 and an abrupt change in the actual gap G.

This latter deformation of the coupling mechanism 125 is not sensed by the encoder 153 and is the main contributor to the unwanted discrepancy between actual gap and the gap setpoint. This elastic deformation prolongs the duration taken for the blanket 114 and for the coupling mechanism 125 to reach a steady-state equilibrium. Again, because the conventional encoder-based positioning mechanisms do not account for the varying deformation of the coupling mechanism 125 when media roller 104 engages seam areas 117 of transfer roller 102, significant unwanted discrepancies persist between the actual gap and the gap setpoint.

As further illustrated in FIG. 7, after the bumping action at the second edge 120 of seam 116, several more hundredths of a second pass while the gap differential stabilizes (represented by portion 358) before eventually leveling off to a generally stable zero reading (represented by 360) as media roller 104 engages non-seam areas 117 of transfer roller 102.

Accordingly, in a conventional system, the gap setpoint profile 260 in FIG. 7 remains generally constant (e.g., at 880 micrometers) while the actual gap G as measured by image sensor 130 (shown in FIG. 2) experiences large swings in value when the seam 116 of the transfer roller 102 passes through interaction zone 127 with media roller 104, as depicted by differential profile 322 illustrated in FIG. 7.

In stark contrast to a conventional system, FIG. 6 also illustrates a gap setpoint profile 270, according to one embodiment of the present disclosure. In particular, gap setpoint profile 270 includes a base value 272 (e.g. 880 μm) for non-seam areas 117 of transfer roller 102, a rising value segment 276 beginning near first edge 118 of seam 116 and continuing into intermediate portion 122, a peak value region 278 at intermediate portion 122 of seam 116, a falling value segment 280 near second edge 120 of seam 116, and a base value 272 for non-seam areas 117 after second edge 120.

This profile 270 depicts increasing the gap setpoint at seam 116 to counteract or compensate for abrupt changes in the gap differential that would otherwise occur because of the elasticity of the coupling mechanism 125 of media roller 104, thereby maintaining a substantially uniform gap even in non-seam areas 117 immediately adjacent seam 116. Accordingly, as illustrated in FIG. 6, the increase in the gap setpoint begins near the first edge 118 of seam 116 and rises (as represented by rising segment 276) until reaching a peak in the intermediate portion 122 (as represented by segment 278), and is decreased steadily as the second edge 120 of seam 116 passes through the interaction zone 127 between media roller 104 and transfer roller 102 (as represented by segment 280) but does not return to the base value 272 until sometime after the second edge 120 of seam 116 has passed beyond the interaction zone 127 with media roller 104.

Accordingly, in contrast to the constant gap setpoint in a conventional gap setpoint profile 260, embodiments of the present disclosure employ a gap setpoint profile 270 that maintains a substantially uniform first gap setpoint (e.g., segments 272) in non-seam areas 117 but temporarily increases the gap setpoint (as represented by segments 276, 278, 280) to produce a second gap setpoint in the vicinity of the seam 116.

FIG. 7 illustrates a gap differential profile 320 that represents the effect of the gap setpoint profile 270 (FIG. 7), according to one embodiment of the present disclosure. In general terms, the gap differential profile 320 reveals that the gap setpoint profile 270, in one embodiment of the present disclosure, produces a dramatically different gap differential profile than a conventional gap differential profile 322 corresponding to the conventional generally constant gap setpoint profile 260.

As illustrated in FIG. 7, the gap setpoint profile 270 (shown in FIG. 6) produces a dramatically different response in the interaction between the transfer roller 102 and the media roller 14 in the vicinity of seam 116. In particular, a gap differential profile 320 (in embodiments of the present disclosure) reveals that the effect of the force disturbance and position disturbance previously seen in the gap differential profile 322 of the conventional system is circumvented in gap differential profile 320 by temporarily increasing the gap setpoint in the vicinity of seam 116. This increase in the gap setpoint directly compensates for the change in deformation of the coupling mechanism of the media roller that would otherwise be caused by the force disturbance associated with the seam(s) of the transfer roller.

As shown in FIG. 7, a gap differential profile 320 includes a base segment 330 representing the gap differential in non-seam areas 117 which extend throughout a substantial majority of the circumference of the transfer roller 102 that is in rolling contact with media roller 104 and form pressure nip 128. However, as media roller 104 passes by the first edge 118 of seam 116, the gap differential of the roller system drops slightly from zero to about negative 40 micrometers (marked via identifier 332) before quickly rising (marked via identifier 334) to a positive value of near 40 micrometers (marked via identifier 336) as media roller 104 passes through the intermediate portion 122 of seam 116.

The gap differential again decreases toward zero (marked via identifier 337) as media roller 104 meets the second edge 120 of seam 116, with the gap differential rising briefly (marked via identifier 338) before falling back towards the base value (marked via identifier 340) as non-seam areas 117 of the transfer roller 102 pass through the pressure nip 128. In particular, the gap differential eventually stabilizes at a generally constant value again as both the coupling mechanism 125 and deformation of the blanket 114 stabilizes, which in turn produces a substantially uniform actual gap G (and substantially uniform pressure) about the circumference of the transfer roller 102 in the non-seam areas 117 of the transfer roller 102. As illustrated in FIG. 7, dashed box 310 identifies a seam-response zone in which there is a substantial reduction in the magnitude of the gap differential in the area of seam 116 and in non-seam areas 117 immediately adjacent seam 116 as a result of temporarily increasing the gap setpoint in seam 116, which in turn leads to a more uniform pressure profile in the vicinity of seam 116.

As illustrated in FIGS. 6-7, temporarily increasing the gap setpoint in seam area 116 minimizes the gap differential between the gap setpoint and the actual gap by compensating for the deformation of the coupling mechanism 125 of media roller 104. This arrangement, in turn, enables maintaining a substantially uniform gap about the entire circumference of the transfer roller 102 and therefore enables maintaining a substantially uniform pressure profile throughout the rotation of the entire circumference of the respective media and transfer rollers 104, 102.

Figure 8:
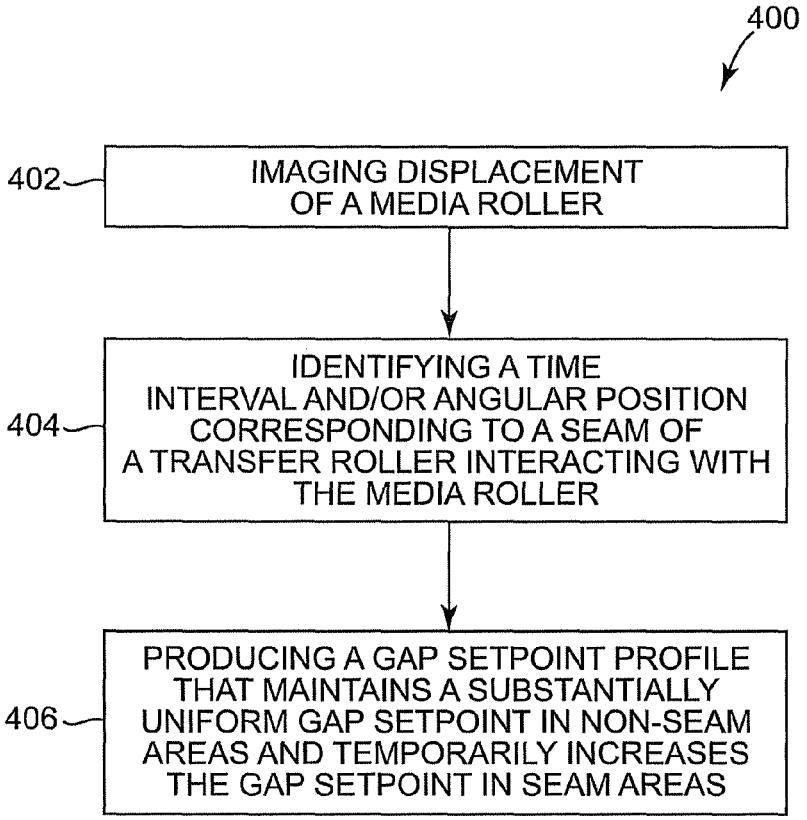
FIG. 8 is a flow diagram illustrating a method of producing a gap setpoint profile, according to one embodiment of the present disclosure.

FIG. 8 illustrates a method 400 of determining a gap setpoint profile, according to one embodiment of the present disclosure. In one embodiment, method 400 employs a system comprising substantially the same features and attributes as the printer, components, and systems as previously described in association with the embodiments of the present disclosure illustrated in FIGS. 1-7. It is understood that the determining the gap setpoint profile is performed for a printer by first applying a substantially uniform gap setpoint (between the media roller and the cylinder of the transfer roller) throughout a complete revolution of the transfer roller, even in the presence of seams such as seam 116 shown in FIG. 2. This determination is made in order to quantify the magnitude and the duration of disruption (from both force and position disturbances) in the pressure and gap between the media roller and the transfer roller that is caused by the seam or recess of the transfer roller as the seam passes through the interaction zone between the transfer roller in the media roller. Based on the measured magnitude and duration of disruption, a gap setpoint profile is identified that temporarily increases the gap setpoint in the vicinity of the seam of the transfer roller to avoid these disruptions. As previously described in association with FIG. 2, the magnitude and duration of disruption is typically measured via an image sensor that is temporarily employed during this evaluation phase of the roller system of the printer (and not present during normal operation of the printer).

Accordingly, in one embodiment, as shown at block 402, image sensing is used to determine the displacement of the media roller relative to transfer roller as the transfer roller rotates through several revolutions. The image sensing identifies patterns as to when, and by how much, the media roller becomes displaced relative to the transfer roller in the area of the seam. As illustrated in FIG. 7, in non-seam areas of the transfer roller, displacement of roller system has a generally constant base value (as represented by segment 330) resulting in a substantially uniform gap G.

On the other hand, when the seam of the transfer roller passes through the interaction zone 127, a significant change of the gap differential profile 322 occurs, as illustrated in the seam-response region 310 of FIG. 7. In one example, segments 352 and 356 of gap differential profile 322 exhibit a large gap differential of a conventional system for the reasons previously explained in association with FIGS. 6-7.

As shown at block 404 in FIG. 8, method 400 includes identifying a time interval and/or angular position corresponding to the seam of the transfer roller passing through the interaction zone between the media roller and the transfer roller. Accordingly, in one aspect, the displacement measurement information (obtained in block 402) is used to identify an angular position of the media roller corresponding to when the seam of the transfer roller passes through the interaction zone. In particular, an angular position of the media roller is identified separately for each of the landmarks associated with seam including first edge, the intermediate portion, and the second edge. By correlating the value of the gap differential with each of these landmarks and the associated angular position of the media roller, one can determine at which angular position the gap setpoint profile is to be modified. Moreover, by viewing the gap differential for the conventional roller system, one can identify the maximum gap differential that occurs in the intermediate portion of seam. In one embodiment, the timing and the magnitude of the temporary increase in the gap setpoint should be set to generally correspond to the timing and the magnitude of the undesired gap differential, except that the gap differential represents a negative value while the increase in the gap setpoint is a positive value, as illustrated in FIGS. 6-7.

In other words, a maximum absolute value of the gap differential is substantially equal to, and generally determines, the magnitude by which the gap setpoint is temporarily increased in the gap setpoint profile 270 of FIG. 6. Accordingly, in one aspect, the increase of the gap setpoint (e.g., gap setpoint profile 270 in FIG. 6) directly offsets the negative value of the gap differential caused by not adjusting the gap setpoint in the vicinity of seam 116 as illustrated by portion 352 of profile 322 in FIG. 8. In another aspect, the duration of the increase in the gap setpoint (e.g., gap setpoint profile 270 in FIG. 6) is substantially equal to the duration of the negative value of the gap differential caused by not adjusting the gap setpoint in the vicinity of seam 116 as illustrated by portion 352 of profile 322 in FIG. 7. In another embodiment, the maximum increase, and the duration of the increase, in the gap setpoint profile 270 (FIG. 7) are selected to vary from the duration and the maximum absolute value of the gap differential caused by not adjusting the gap setpoint in the vicinity of seam 116 as illustrated by portion 352 of profile 322 in FIG. 7.

As illustrated in FIG. 6, by using this measurement information, the increase in the gap setpoint (represented by portion 276) is set to begin just prior to the first edge 118 of seam 116 and remains substantially greater than the base value 272 (at peak 278 and decreasing portion 280) until the second edge 120 of the seam 116 passes completely through interaction zone 127 when the gap setpoint returns the base value 272.

In another aspect, the displacement measurement information also reveals the time interval or angular interval at which the large absolute value of gap differential (i.e., maximum displacement) occurs. This time interval is also used to determine when to temporarily increase the gap setpoint to counteract the force disturbances and position disturbances that would otherwise occur if a constant gap setpoint was maintained when the seam 116 passes through the interaction zone 127.

Accordingly, as shown in FIG. 8, method 400 includes producing a gap setpoint profile that maintains a substantially uniform gap in non-seam areas and temporarily increases the gap setpoint in seam areas based on the time interval and angular position determined from the displacement measurement information, as shown at block 406.

As previously mentioned, embodiments of the present disclosure are not limited solely to a media roller and a transfer roller in a printer but extend to the interaction of other combinations of rollers in rolling contact with each other (in a printer) and in which a gap is to be controlled between the two respective rollers with one or both of the respective rollers having one or more seams on their outer surface.

Embodiments of the present disclosure insure application of a substantially uniform pressure at a pressure nip between a transfer roller and a media roller despite large discontinuities, such as a seam, in a surface of the transfer roller or the media roller. These embodiments preserve the life and maintain the effectiveness of the blanket while increasing the quality of printing. These embodiments do not employ searching for obstacles or reacting to obstacles after they are encountered. Instead, a gap setpoint profile is established for a roller system that automatically causes a temporary change in a gap setpoint in anticipation of a seam of a transfer roller passing through an interaction zone to enable the roller control system to successfully operate within its capacity limit (given the imperfection of the position reading inferred from a conventional encoder coupled to the axis of the translation motor).

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A printer comprising:

a transfer roller including an at least partially compressible blanket and defining at least one seam extending generally parallel to a longitudinal axis of the transfer roller, wherein the transfer roller includes a cylinder with the blanket secured about the cylinder;

a media roller positioned for rolling contact against the blanket of the transfer roller under pressure as a media passes through a nip between the respective rollers, wherein the blanket is under compression at the nip, wherein at least one of the media roller and the transfer roller includes a translatable rotational axis; and means for maintaining a substantially uniform pressure on the blanket as an entire circumference of the transfer roller passes through a location of the nip, wherein the means for maintaining includes:

a positioning mechanism configured to maintain a substantially uniform gap between the media roller and an outer surface of the cylinder of the transfer roller via application of a first gap setpoint when non-seam areas of the transfer roller pass through the nip and via application of a second gap setpoint, greater than the first gap setpoint, when the at least one seam of the transfer roller passes through a location of the nip at which no printing occurs, wherein the positioning mechanism includes:

a coupling portion coupled to the translatable rotatable axis; and a control portion configured to implement the respective first and second gap setpoints by varying the position, via at least the translatable rotatable axis, of the media roller and the transfer roller relative to each other based, at least in part, on observable effects associated with deformation behavior of the coupling portion.

2. The printer of claim 1 wherein the positioning mechanism comprises at least one of the transfer roller or the media roller including a rotational axis having a fixed position and the other one of the respective media roller and transfer roller including a rotational axis having a translatable position.

3. The printer of claim 1 wherein the printer comprises:

an imaging roller in rolling contact under pressure against the transfer roller;

a charging station configured to cause a substantially uniformly charged surface on the imaging roller;

an imager configured to discharge the surface of the imaging roller in a pattern corresponding to an image; and a developing station configured to apply ink to the discharged portion of the surface of the imaging roller to form an inked image, wherein the inked image carried on the surface of the imaging roller is transferred onto the blanket of the transfer roller via the rolling contact between the image roller and the transfer roller and also transferred onto the media via the rolling contact between the transfer roller and the media roller.

4. The printer of claim 1, wherein the observable effects associated with deformation behavior of the coupling portion include predefined image-based displacement information regarding the translatable rotational axis.

5. The printer of claim 4, wherein the predefined image-based displacement information is determined during an evaluation phase of the printer and then is subsequently employed as a fixed operating parameter of the printer and of other substantially similar printers, wherein the predefined image-based displacement information is determined via operating the printer in the evaluation phase exclusively with the first gap setpoint and without the second gap setpoint, and wherein the predefined, image-based displacement information is associated with the at least one seam passing through the location of the nip and includes a magnitude of, and a duration of, the displacement of the translatable rotational axis of one of the media and transfer rollers relative to the rotational axis of the other respective one of the media and transfer rollers.

6. A printer comprising:

a transfer roller including a blanket and defining at least one seam extending generally parallel to a longitudinal axis of the transfer roller, wherein the transfer roller includes a cylinder with the blanket secured about the cylinder;

a media roller positioned for rolling contact against the blanket of the transfer roller under pressure as a media passes through a nip between the respective rollers, wherein the blanket is under compression at the nip; and means for maintaining a substantially uniform pressure on the blanket as an entire circumference of the transfer roller passes through a location of the nip, wherein the means for maintaining a substantially uniform pressure comprises:

a positioning mechanism configured to maintain a substantially uniform gap between the media roller and the cylinder of the transfer roller via application of a first gap setpoint when non-seam areas of the transfer roller pass through the nip and via application of a second gap setpoint, greater than the first gap setpoint, when the at least one seam of the transfer roller passes through a location of the nip at which no printing occurs, wherein the positioning mechanism comprises at least one of the transfer roller or the media roller including a rotational axis having a fixed position and the other one of the respective media roller and transfer roller including a rotational axis having a translatable position, wherein the positioning mechanism comprises:

a translation motor configured to cause translation of the translatable rotational axis to vary the position of the media roller and the transfer roller relative to each other;

an encoder associated with, and configured to measure translation of, the translatable rotational axis; and a controller configured to operate the translation motor according to a gap setpoint profile to achieve the substantially uniform gap, wherein the gap setpoint profile includes:

applying the first gap setpoint in the non-seam areas, via feedback from the encoder, to achieve the substantially uniform gap in the non-seam areas; and applying the second gap setpoint at the at least one seam, via predefined image-based displacement information regarding the translatable rotational axis and via feedback from the encoder, to substantially achieve the substantially uniform gap at the at least one seam.

7. The printer of claim 6 wherein the predefined image-based displacement information is determined during an evaluation phase of the printer and then is subsequently employed as a fixed operating parameter of the printer and of other substantially similar printers, wherein the predefined image-based displacement information is determined via operating the printer in the evaluation phase exclusively with the first gap setpoint and without the second gap setpoint, and wherein the predefined, image-based displacement information is associated with the at least one seam passing through the location of the nip and includes a magnitude of, and a duration of, the displacement of the translatable rotational axis of one of the media and transfer rollers relative to the rotational axis of the other respective one of the media and transfer rollers.

8. The printer of claim 6 wherein the printer comprises:

an imaging roller in rolling contact under pressure against the transfer roller;

a charging station configured to cause a substantially uniformly charged surface on the imaging roller;

an imager configured to discharge the surface of the imaging roller in a pattern corresponding to an image; and a developing station configured to apply ink to the discharged portion of the surface of the imaging roller to form an inked image, wherein the inked image carried on the surface of the imaging roller is transferred onto the blanket of the transfer roller via the rolling contact between the image roller and the transfer roller and also transferred onto the media via the rolling contact between the transfer roller and the media roller.

9. A printer comprising:

a transfer roller including an at least partially compressible blanket and defining at least one seam extending generally parallel to a longitudinal axis of the transfer roller, wherein the transfer roller includes a cylinder with the blanket secured about the cylinder;

a media roller positioned for rolling contact against the blanket of the transfer roller under pressure as a media passes through a nip between the respective rollers, wherein the blanket is under compression at the nip, wherein at least one of the media roller and the transfer roller includes a translatable rotational axis; and means for maintaining a substantially uniform pressure on the blanket as an entire circumference of the transfer roller passes through a location of the nip, wherein the means for maintaining includes:

a positioning mechanism configured to maintain a substantially uniform gap between an outer surface of the media roller and an outer surface of the cylinder of the transfer roller via application of a first gap setpoint when non-seam areas of the transfer roller pass through the nip and via application of a second gap setpoint, greater than the first gap setpoint, when the at least one seam of the transfer roller passes through a location of the nip at which no printing occurs, wherein the positioning mechanism includes:

a translation portion to cause translation of the translatable rotatable axis to vary the position of the media roller and the transfer roller relative to each other;

a coupling portion interposed between the translation portion and the translatable rotatable axis; and a control portion configured to implement at least the second gap setpoint via implementing the position, via the translation portion, of the media roller and the transfer roller relative to each other, wherein the implementation is based, at least in part, observed displacement information associated with elastic behavior of the coupling portion.

10. The printer of claim 9 wherein the printer comprises:

an imaging roller in rolling contact under pressure against the transfer roller;

a charging station configured to cause a substantially uniformly charged surface on the imaging roller;

an imager configured to discharge the surface of the imaging roller in a pattern corresponding to an image; and a developing station configured to apply ink to the discharged portion of the surface of the imaging roller to form an inked image, wherein the inked image carried on the surface of the imaging roller is transferred onto the blanket of the transfer roller via the rolling contact between the image roller and the transfer roller and also transferred onto the media via the rolling contact between the transfer roller and the media roller.

* * * * *